US009725857B2

(12) United States Patent
Cho

(10) Patent No.: US 9,725,857 B2
(45) Date of Patent: Aug. 8, 2017

(54) CRASH CUSHION

(71) Applicant: SHINSUNG CONTROL CO., LTD., Asan-si, Chungcheongnam-do (KR)

(72) Inventor: Kyu-Hyun Cho, Seongnam-si (KR)

(73) Assignee: SHINSUNG CONTROL CO., LTD., Asan-si, Chungcheongnam-do (KR)

( * ) Notice: Subject to any disclaimer, the term of this patent is extended or adjusted under 35 U.S.C. 154(b) by 0 days.

(21) Appl. No.: 14/901,917

(22) PCT Filed: Oct. 31, 2014

(86) PCT No.: PCT/KR2014/010349
§ 371 (c)(1),
(2) Date: Dec. 29, 2015

(87) PCT Pub. No.: WO2015/068985
PCT Pub. Date: May 14, 2015

(65) Prior Publication Data

US 2016/0369460 A1 Dec. 22, 2016

(30) Foreign Application Priority Data

Nov. 5, 2013 (KR) ..... 10-2013-0133698
May 14, 2014 (KR) ..... 10-2014-0057896

(51) Int. Cl.
*E01F 15/04* (2006.01)
*E01F 15/14* (2006.01)

(52) U.S. Cl.
CPC ..... *E01F 15/0438* (2013.01); *E01F 15/043* (2013.01); *E01F 15/146* (2013.01)

(58) Field of Classification Search
CPC ..... E01F 15/00; E01F 15/14; E01F 15/143; E01F 15/145; E01F 15/146
USPC ..... 404/6, 10
See application file for complete search history.

(56) References Cited

U.S. PATENT DOCUMENTS 3,143,321 A * 8/1964 McGehee ..... B64C 25/62 188/376
3,779,591 A * 12/1973 Rands ..... F16F 7/127 188/375
4,923,327 A 5/1990 Gorlov
5,733,062 A * 3/1998 Oberth ..... E01F 15/146 256/13.1

(Continued)

FOREIGN PATENT DOCUMENTS

KR 20-0277419 Y1 6/2002
KR 20-0390564 Y1 7/2005

(Continued)

*Primary Examiner* — Gary Hartmann
(74) *Attorney, Agent, or Firm* — Novick, Kim & Lee, PLLC; Jae Youn Kim

(57) ABSTRACT

The crash cushion includes: a rail installed on the ground surface; a front support that is installed on a front end of the rail and is pushed backward along the rail when a shock is applied to the front support; a rear support installed on a rear end of the rail; and a shock absorber that is installed extending from the front support to the rear support and disposed at a predetermined height from the ground surface. The shock absorber includes a punch and a pipe, and it absorbs shock in such a way that the pipe is expanded in diameter by the punch. The crash cushion is installed on a road and can effectively absorb shock caused by a vehicle collision.

15 Claims, 18 Drawing Sheets

(56) References Cited

U.S. PATENT DOCUMENTS 6,231,095 B1 * 5/2001 Chou ..... B60R 19/34 188/371
6,308,809 B1 * 10/2001 Reid ..... F16F 7/125 188/377
6,409,239 B1 * 6/2002 Tjoelker ..... B60R 19/34 188/376
6,457,570 B2 * 10/2002 Reid ..... F16F 7/125 188/377
6,536,986 B1 * 3/2003 Anghileri ..... E01F 15/146 404/10
6,623,204 B2 * 9/2003 Buehler ..... E01F 15/146 404/10
6,668,989 B2 * 12/2003 Reid ..... E01F 15/148 188/377
6,811,144 B2 * 11/2004 Denman ..... E01F 15/146 256/13.1
6,905,281 B2 * 6/2005 Kang ..... E01F 15/146 404/6
7,147,088 B2 * 12/2006 Reid ..... F16F 7/125 188/374
7,185,882 B2 * 3/2007 Buth ..... E01F 15/143 248/66
7,325,789 B2 * 2/2008 Buth ..... E01F 15/143 256/13.1
7,484,781 B1 * 2/2009 Garber ..... B60R 19/34 293/132
8,033,749 B2 * 10/2011 McKenney ..... E01F 15/146 256/13.1
8,430,596 B2 * 4/2013 McKenney ..... E01F 15/146 256/13.1
8,714,866 B2 * 5/2014 Albritton ..... E01F 15/0423 404/10
9,051,698 B1 * 6/2015 Anghileri ..... E01F 15/146
9,297,129 B1 * 3/2016 Eriksen ..... E01F 15/143
2003/0070894 A1 * 4/2003 Reid ..... E01F 15/143 188/377
2006/0054876 A1 3/2006 LaTurner et al.

FOREIGN PATENT DOCUMENTS

KR 10-2012-0015020 A 2/2012
KR 20-2012-0004200 U 6/2012
KR 10-1267446 B1 5/2013

* cited by examiner

CRASH CUSHION

TECHNICAL FIELD

The present invention generally relates to crash cushions. More particularly, the present invention relates to a crash cushion that is installed on a road and can effectively absorb a shock caused by a collision of a vehicle, thus reducing damage to the vehicle, and minimizing loss of life.

BACKGROUND ART

As use of vehicles is becoming more common, the volume of traffic is rapidly increasing. In proportion to this, the number of traffic accidents is also increasing. Furthermore, as a high-speed travel resulting from the improvement in performance of vehicles has become widespread, the number of large accidents causing large loss of life and property is also increasing.

Of vehicle accidents, a collision of a vehicle with road safety facilities is an accident in which only a single vehicle is involved. Inexperience, carelessness, or drowsiness is known as the primary reasons for single-vehicle accidents.

To prevent collision accidents with road facilities, various efforts including maintenance of road safety facilities, campaigns for increasing driving safety, etc. must be made. However, such efforts alone to prevent single vehicle accidents are not sufficient. Therefore, safety facilities for shock absorption have been installed at places where there are possibilities of single-vehicle accidents.

Guardrails and crash cushions installed ahead of the guardrails are representative examples of safety facilities for shock absorption. Guardrails function to absorb shocks mainly caused by side collisions. Crash cushions function to absorb shocks caused by frontal collisions. An example of such crash cushions was proposed in Korean Patent Registration No. 10-1267446 (May 31, 2013), entitled "CRASH CUSHION FOR ABSORBING SHOCK IN COLLISION OF VEHICLE WITH FRONT PART OF GUARDRAIL."

Such a crash cushion must have the capability to absorb shock transmitted from a high-speed traveling vehicle and to minimize damage. Therefore, a structure that can effectively absorb shock is essentially required for the crash cushion.

DISCLOSURE

Technical Problem

Accordingly, the present invention has been made keeping in mind the above problems occurring in the prior art, and an object of the present invention is to provide a crash cushion that can effectively absorb a shock caused by a collision of a vehicle, thus minimizing loss of life and property in a vehicle accident.

Technical Solution

In order to accomplish the above object, the present invention provides a crash cushion including a shock absorber that absorbs a shock in such a way that a punch expands the diameter of a pipe, whereby the shock can be effectively absorbed.

Advantageous Effects

A crash cushion according to the present invention is installed on a road and is able to effectively absorb shock caused by a vehicle collision, thus enhancing the safety for passengers, thereby minimizing loss of life, reducing damage to a vehicle, and also minimizing property damage.

BEST MODE

The present invention provides a crash cushion that can effectively absorb shock caused by a vehicle collision and thus minimize loss of life. The crash cushion includes: a rail installed on the ground surface; a front support that is installed on a front end of the rail and is pushed backward along the rail when a shock is applied to the front support; a rear support installed on a rear end of the rail; and a shock absorber that is installed extending from the front support to the rear support and disposed at a predetermined height from the ground surface. The shock absorber includes a punch and a pipe and absorbs the shock in such a way that the pipe is expanded in diameter by the punch.

Figure 1:
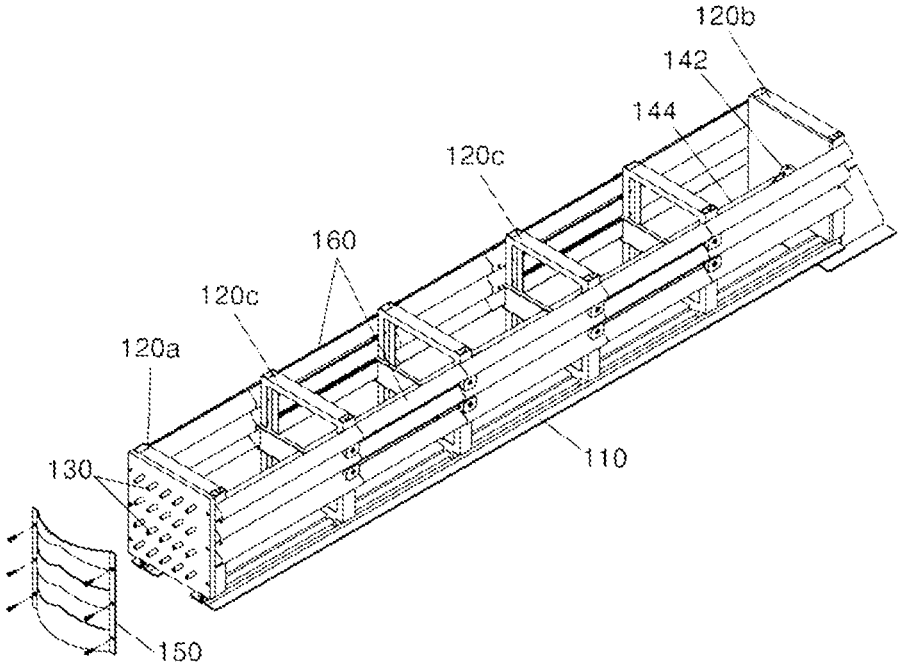
FIG. 1 is a view illustrating a crash cushion according to the present invention.
Figure 2:
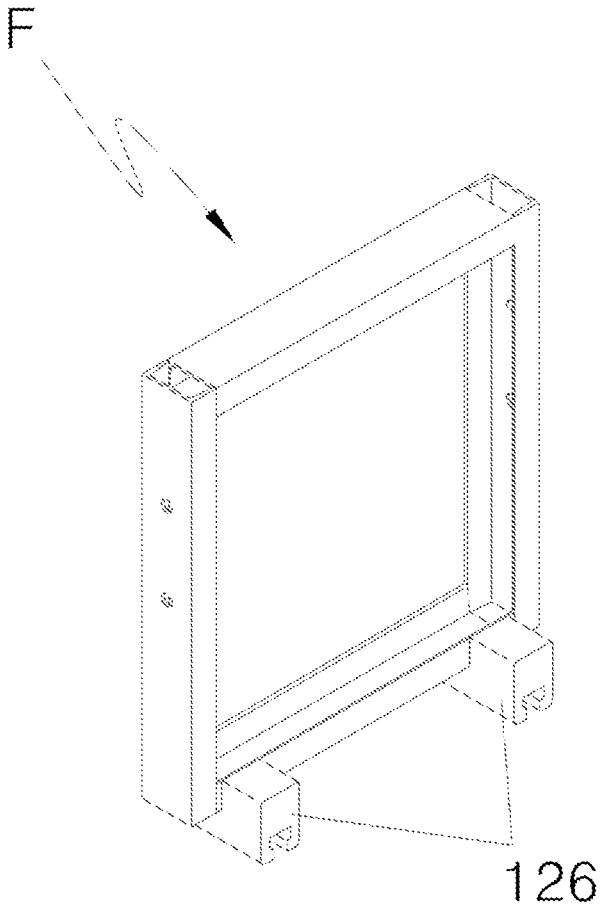
FIG. 2 is a view showing a support frame that is a basic component of a front, rear or intermediate support according to the present invention.
Figure 3:
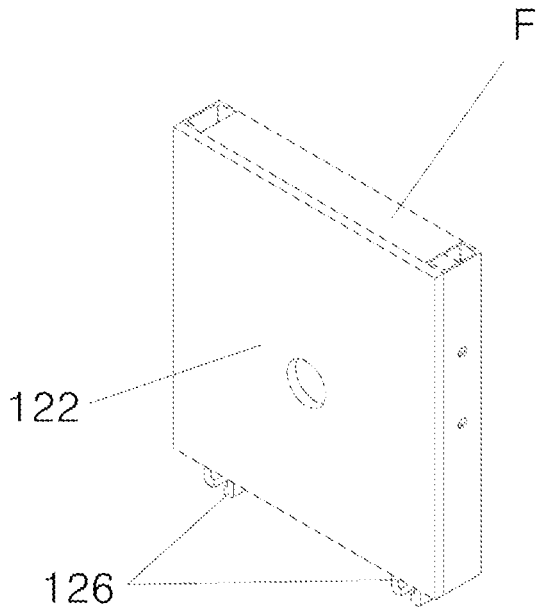
FIGS. 3 through 5 are views showing several examples of the front, rear or intermediate support using the support frame.
Figure 4:
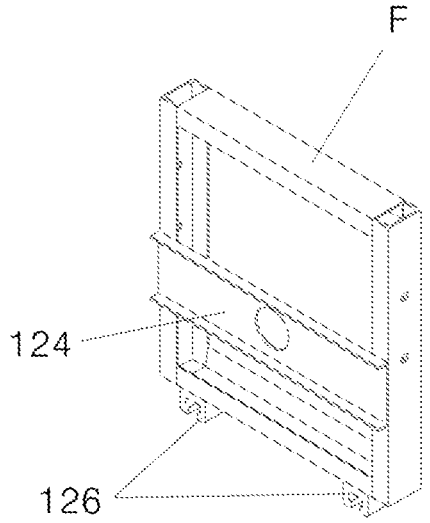
Figure 5:
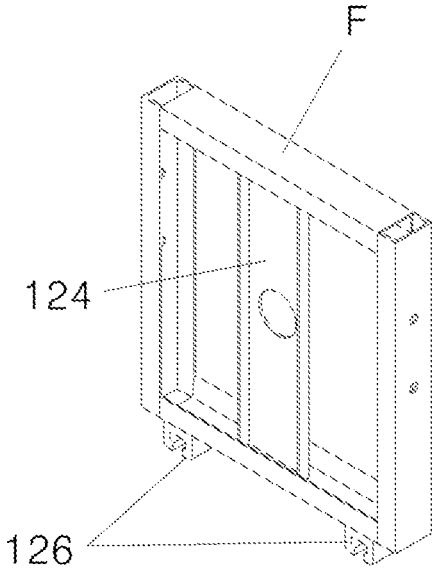
Figure 6:
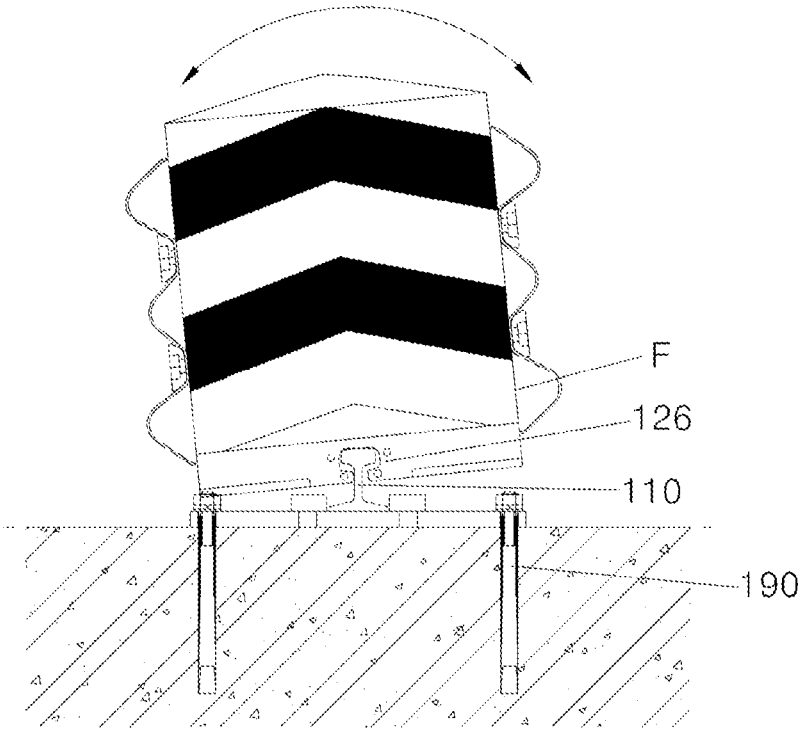
FIG. 6 is a view showing the support frame installed on a single rail.
Figure 7:
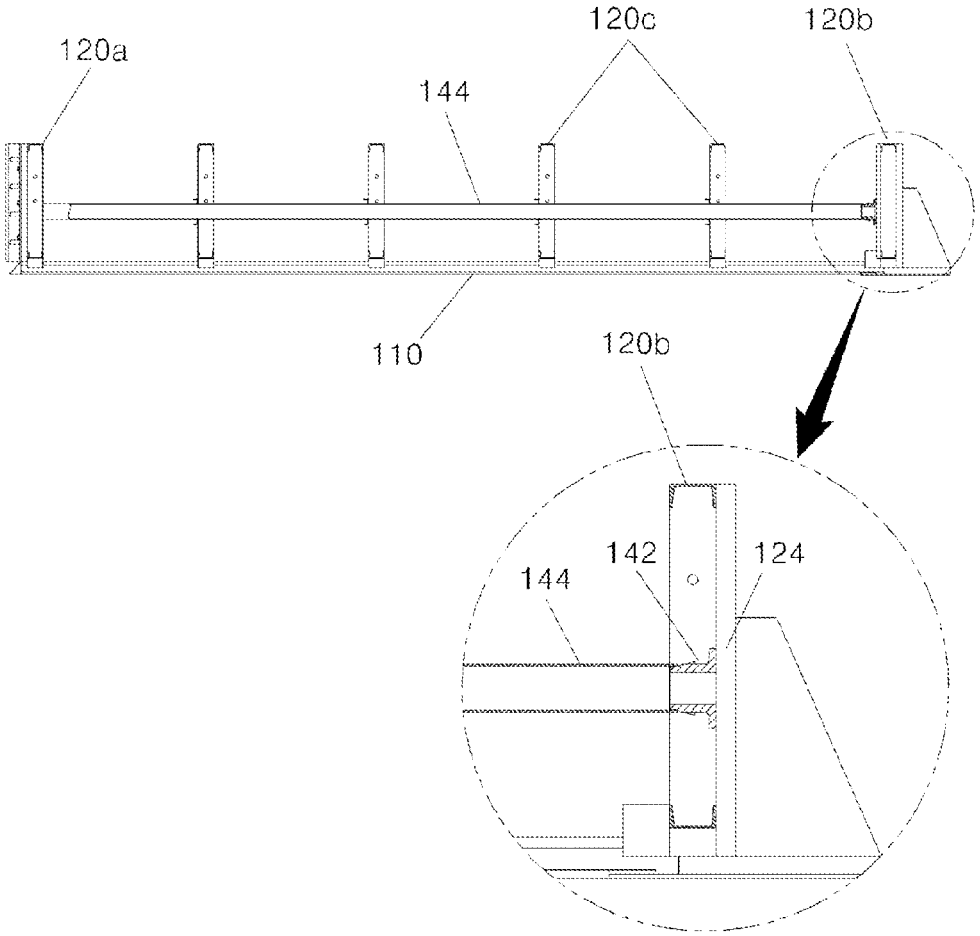
FIG. 7 is a view illustrating the installation structure of a shock absorber according to the present invention.
Figure 8:
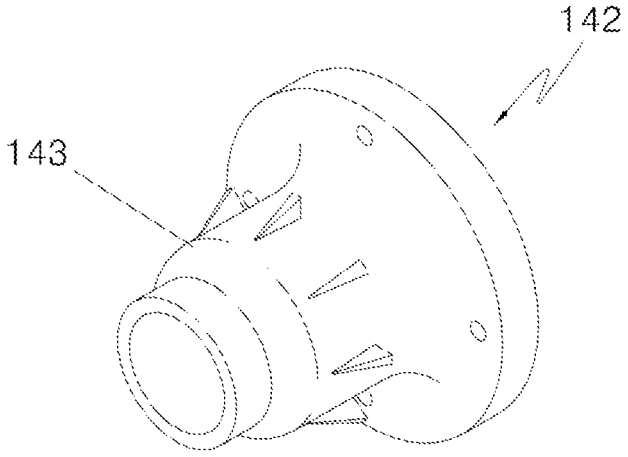
FIGS. 8 through 10 are views illustrating examples of a punch used in the shock absorber according to the present invention.
Figure 9:
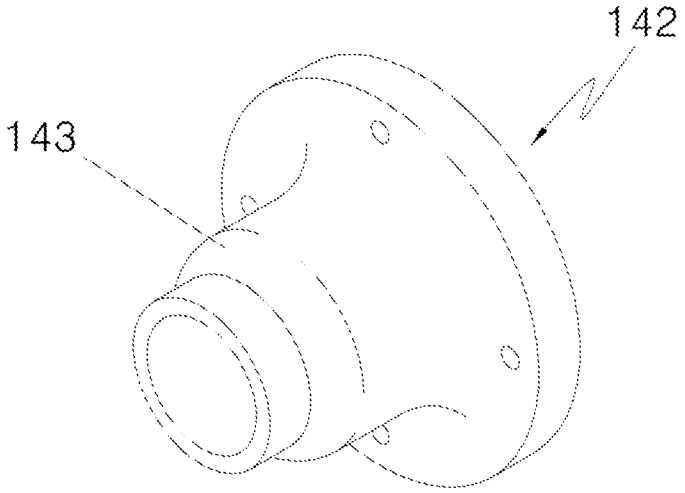
Figure 10:
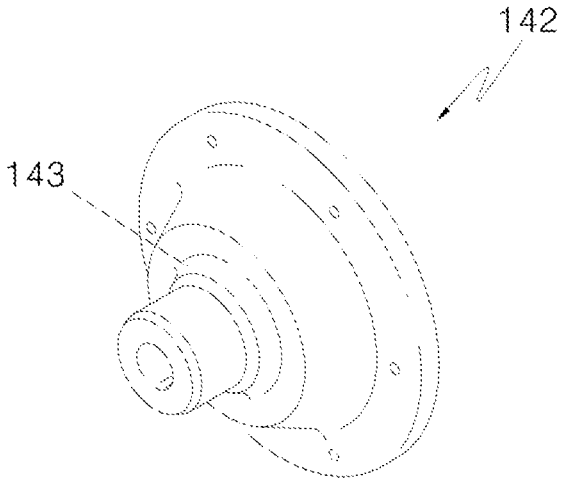
Figure 11:
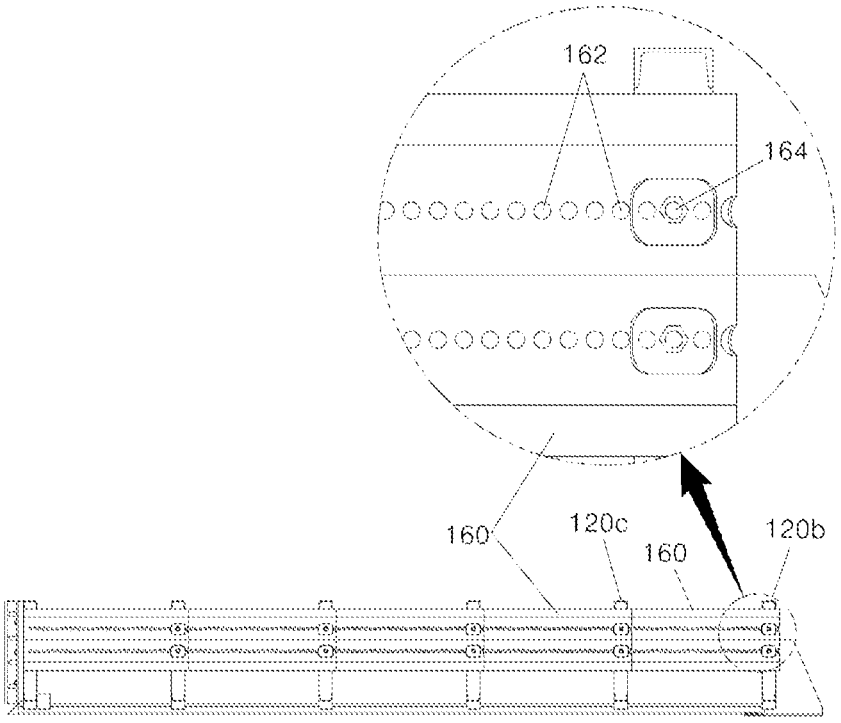
FIGS. 11 and 12 are views illustrating examples of a sliding panel according to the present invention.
Figure 12:
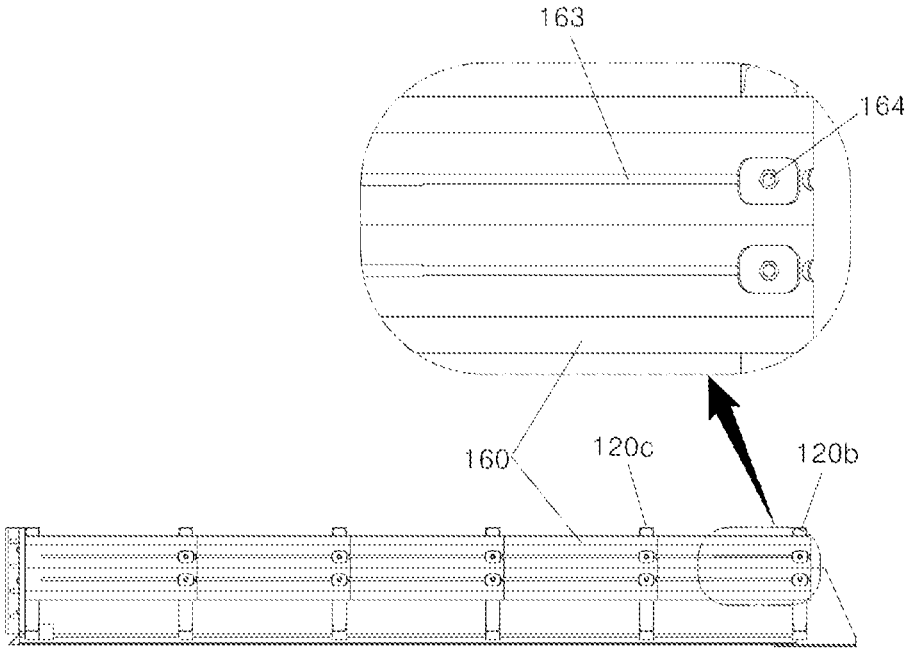

Hereinafter, the present invention will be described in detail with reference to FIGS. 1 through 21. FIG. 1 is a view illustrating a crash cushion according to the present invention. FIG. 2 is a view showing a support frame that is a basic component of a front, rear or intermediate support according to the present invention. FIGS. 3 through 5 are views showing several examples of the front, rear or intermediate support using the support frame. FIG. 6 is a view showing the support frame installed on a single rail. FIG. 7 is a view illustrating the installation structure of a shock absorber according to the present invention. FIGS. 8 through 10 are views illustrating examples of a punch used in the shock absorber according to the present invention. FIGS. 11 and 12 are views illustrating examples of a sliding panel according to the present invention.

As shown in the drawings, the crash cushion according to the present invention includes a rail 110, a front support 120*a*, a rear support 120*b*, and a shock absorber having a punch 142 and a pipe 144.

The rail 110 comprises a pair of rails 110 that are installed on a ground surface. The rails 110 are provided parallel to each other at positions spaced apart from each other by a predetermined distance. A typical flat-bottom rail, which is widely used as a rail for railways track, may be used as each rail 110. The rails 110 are reliably fastened to the ground surface by a fastening means such as an anchor bolt such that even when a shock is applied to the crash cushion of the present invention, the rails 110 cannot be removed from the ground surface. The number of rails 110 may be changed as needed, for example, one or three rails may be provided.

The front support 120*a* is installed on front ends of the rails 110 in such a way that the front support 120*a* is coupled at a lower end thereof to the rail 110 and thus placed upright. The front support 120*a* is configured such that it can move along the rail 110 without being removed from the rails 110. In this embodiment of the present invention, the above coupling of the front support 120*a* to the rails 110 can be achieved by sliders 126, each of which is slidably fitted over the corresponding rail 110. As needed, a roller may be provided in each slider 126 so that the slider 126 can smoothly move along the rail 110.

Embedding protrusions 130 are provided on a front surface of the front support 120*a*. Each embedding protrusion 130 protrudes from the front support 120*a* by a predetermined distance. When a vehicle collides with the front support 120*a*, the embedding protrusions 130 are embedded into a front part, for example, a bumper, of the vehicle, thus preventing the vehicle from undesirably slipping. That is, the embedding protrusions 130 can prevent secondary accident, which may occur because of a slip of the vehicle. In order to prevent the exposure of the embedding protrusions 130 to the outside and thus prevent deterioration in the appearance of the crash cushion, a thin cover plate 150 made of metal or plastic may be coupled to the front support 120*a*.

The rear support 120*b* is installed on rear ends of the rails 110. The rear support 120*b* supports a rear end of the shock absorber and functions to prevent the shock absorber from being pushed rearward. Thereby, the shock absorber can be reliably fixed in place.

Each of the front and rear supports 120*a* and 120*b* is quadrangular and may be formed of a support frame F that is made of a metal beam. As shown in FIG. 2, the support frame F is made of a rectangular metal beam. As shown in FIG. 3, a metal plate 144 may be provided on a surface of the support frame F. Alternatively, as shown in FIG. 4 or 5, a support beam 124 may be longitudinally or laterally provided on the support frame F. The support frame F is not limited to the above examples and can have any structure so long as it is quadrangular. Furthermore, as needed, a variety of members for reinforcement may be added to the support frame F.

For the front support 120*a*, sliders 126 are provided under a lower end of the support frame F. Each slider 126 has a depression that has a shape corresponding to the cross-sectional shape of the rail 110 and has a cross-sectional area larger than that of the rail 110. The support frame F is installed on the rail 110 in such a way that the rail 110 is inserted into the depression of the slider 126 so that the support frame F can move along the rail 110.

As shown in FIG. 2, the slider 126 has a length longer than the thickness of a side surface of the support frame F so that the slider 126 protrudes rearward from the support frame F.

Thereby, the front support 120*a* can be more reliably moved when it is pushed rearward along the rails 110. The above structure of the slider 126 can also be applied to the intermediate support 120*c* as well as to the front support 120*a*.

The number of sliders 126 and the installation positions thereof are determined depending on the number of rails 100 and the installation positions thereof. For example, if only a single rail 100 is provided, as shown in FIG. 6, a single slider 126 is provided on an intermediate portion of the support frame F with respect to the lateral direction of the support frame F. In this construction, the depression into which the rail 110 is inserted has a shape corresponding to the cross-sectional shape of the rail 110, and the cross-sectional area of the depression is larger than that of the rail 110. Therefore, the support frame F can be tilted on the rail 110 to the left or right within a predetermined angular range. As such, if the support frame F is designed so as to be tiltable to the left or right, the entirety of the crash cushion according to the present invention can also be tilted to the left or right within a predetermined angular range after the installation thereof has been completed. Consequently, even when a shock is applied from a vehicle or the like to the crash cushion in an oblique direction rather than in the frontal direction, the front support 120*a* and the intermediate support 120*c* are tilted by a predetermined angle and pushed backward in a direction in which the shock is applied, thus absorbing the shock. Here, because the cross-sectional area of the depression into which the rail 110 is inserted is larger than that of the rail 110, the friction between the depression and the rail 110 is reduced. Thereby, the front support 120*a* and the intermediate support 120*c* can be easily moved.

Meanwhile, in the above-mentioned construction in which the front support 120*a* and the intermediate support 120*c* can be tilted to the left or right, the angle by which they can tilted can be limited by anchor bolts 190, each of which is embedded in the ground and is brought into contact with either of the opposite edges of the lower end of the support frame F. It is preferable that the angle by which the front support 120*a* and the intermediate support 120*c* can be tilted be about 6°.

The shock absorber includes a pipe 144 that extends from the front support 120*a* to the rear support 120*b* and is disposed at a predetermined height from the ground, and a punch 142 that expands the diameter of the pipe 144. It is preferable that the height at which the shock absorber is disposed be set to be similar to a height of a bumper of a vehicle that may collide with the crash cushion.

The pipe 144 is made of metal and has a cylindrical shape. The punch 142 is disposed on a rear end of the pipe 144 and configured such that when a vehicle collides with the crash cushion, the punch 142 can expand the diameter of the pipe 144 that is pushed by the front support 120*a* pressed backward by the vehicle. The punch 142 can be fixed to the front support 120*a* or the rear support 120*b*. In this embodiment, the punch 142 is fixed to the rear support 120*b* and expands the diameter of the rear end of the pipe 144. Thereby, even when the front support 120*a* is tilted in some degree and pushed backward by the vehicle colliding with the front support 120*a*, the punch 142 can reliably expand the diameter of the pipe 144 without being removed from the pipe 144. The punch 142 having the above-mentioned structure may be fixed by a bolt, but it is not limited thereto.

As shown in FIGS. 8 through 10, the punch 142 generally has a circular cross-section and includes a large diameter part 143 that is increased in diameter from a front end thereto to a rear end. The large diameter part 143 is coupled to the pipe 144 with its front end fitted into the pipe 144. A cutting blade is formed on the front end of the large diameter part 143. The cutting blade makes the punch 142 cut the pipe 144 while moving forward relative to the pipe 144.

The crash cushion according to the present invention may further include the intermediate support 120*c* that is installed between the front support 120*a* and the rear support 120*b*. The intermediate support 120*c* is installed on the rail 110 and supports the pipe 144. The intermediate support 120*c* is made of a support frame F in the same manner as that of the front support 120*a* or the rear support 120*b*. A hole through which the pipe 144 passes is formed in the intermediate support 120*c* so that the pipe 144 is supported by the intermediate support 120*c*. When a vehicle collides with the crash cushion, the intermediate support 120*c* is pushed backward along the rail 110 while overlapping the front support 120*a* that is pushed backward by the collision of the vehicle.

In the present invention, at least one intermediate support 120*c* is provided. The number of intermediate supports 120*c* can be changed depending on the length of the pipe 144. If a plurality of intermediate supports 120*c* are provided, they are spaced apart from each other at regular intervals between the front support 120*a* and the rear support 120*b*. The intervals at which the intermediate supports 120*c* are spaced apart from each other can be adjusted as needed.

A space between the front support 120*a* and the rear support 120*b* is filled with a buffer (not shown). The buffer is configured to effectively absorb a shock. Given the fact that the present invention is provided to absorb a shock transmitted from a vehicle, a buffer that can effectively absorb a shock is used. For instance, the buffer may have a honeycomb structure in which bent metal plates are connected to each other in such a way that bent parts of the metal plates make contact with each other. As needed, the buffer may be made of a waste tire or a plastic tank filled with water.

The crash cushion according to the present invention further includes a sliding panel 160 that extends from the front support 120*a* to the rear support 120*b* and covers both the front support 120*a* and the rear support 120*b* to form the outer surface of the crash cushion.

The sliding panel 160 has a planar shape. If the intermediate support 120*c* exists, a plurality of sliding panels 160 is provided. Each sliding panel 160 is fixed at a front end thereof to the front support 120*a* or the intermediate support 120*c* and is installed such that a rear end of each preceding sliding panel 160 partially overlaps a front end of a following sliding panel 160.

The sliding panel 160 may separately comprise a panel that covers the side surfaces of the front and rear supports 120*a* and 120*b*, and a panel that covers the upper surfaces of the front and rear supports 120*a* and 120*b*. Alternatively, the sliding panel 160 may have an integrated structure covering both the side surfaces and the upper surfaces of the front and rear supports 120*a* and 120*b* (in the drawings, a structure covering the side surfaces is illustrated). When the front support 120*a* is pushed backward by a shock, the sliding panel 160 is pushed backward along with the front support 120*a*. In the case where the intermediate support 120*c* is provided, when the intermediate support 120*c* is pushed backward, the sliding panel 160 is also pushed backward along with the intermediate support 120*c*.

In an embodiment, as shown in FIG. 11, a plurality of holes 162 are formed in the sliding panel 160 and arranged in a line in the longitudinal direction of the sliding panel 160. A bolt 144 is tightened into a corresponding one of the holes 162 that are formed in a rear end of the sliding panel 160, thus supporting the rear end of the sliding panel 160. When the sliding panel 160 is pushed backward, portions between the holes 162 are successively broken by the bolt 164 that supports the rear end of the sliding panel 160, whereby the shock absorption performance can be further enhanced.

Alternatively, as shown in FIG. 12, in lieu of the holes 162, a slit 163 may be formed in the sliding panel 160. The width of the slit 163 is less than the diameter of the bolt 144. Thus, when the sliding panel 160 is pushed backward, the bolt 144 passes through the slit 163 while expanding the width of the slit 163, thereby contributing to shock absorption.

Figure 13:
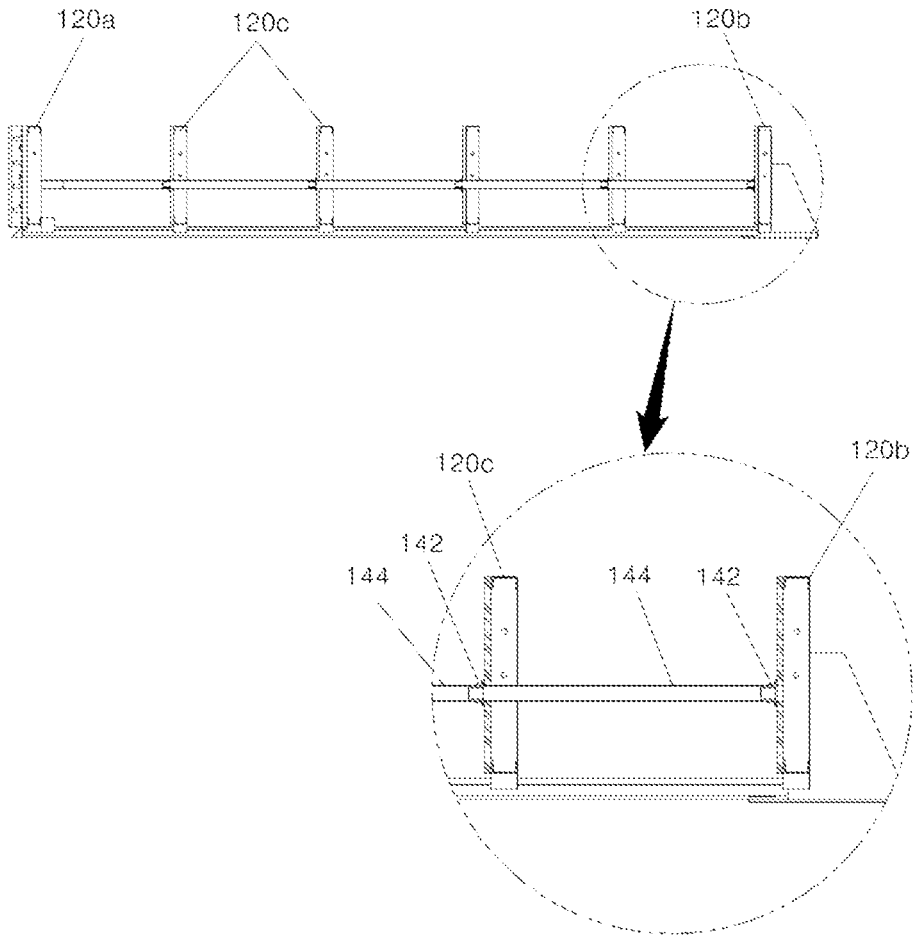
FIGS. 13 and 14 are views illustrating another embodiment of the installation structure of the shock absorber according to the present invention.
Figure 14:
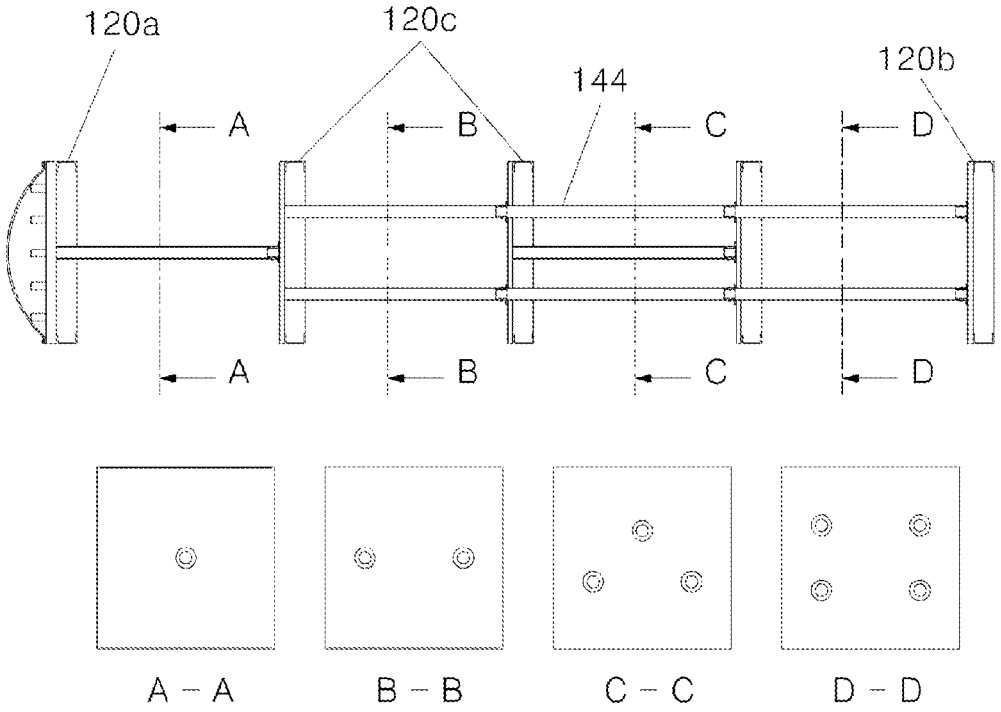

FIGS. 13 and 14 are views illustrating another embodiment of the installation structure of the shock absorber according to the present invention.

In the present invention, a plurality of shock absorbers may be provided. In this case, as shown in FIG. 13, the shock absorbers may be arranged in a line. That is, a plurality of pipes 144 are arranged in a line from the front support 120*a* to the rear support 120*b*. A punch 142 is installed on a rear end of each pipe 144. In this way, the shock absorbers are arranged in a line. Here, the adjacent pipes 144 can be connected to each other in such a way that the punch 142 that is installed on the rear end of each preceding pipe 144 supports the front end of the following pipe 144. As shown in the drawing, a depression into which the front end of the corresponding pipe 144 is inserted is formed in the rear end of each punch 142 so that the adjacent pipes 144 can be connected to each other.

As such, in the structure in which the shock absorbers are arranged in a row, the shock absorbers must be supported at appropriate positions to ensure reliable operation. Preferably, the shock absorbers are supported at the junctions between the shock absorbers. In the present invention, the above purpose can be achieved by the intermediate supports 120*c*. In detail, the punches 142 are respectively fastened to the rear support 120*b* and the intermediate supports 120*c*, and the front end of each punch 142 is inserted into the rear end of the corresponding pipe 144. In this construction, when a shock is applied to the front support 120*a*, the pipes 144 of the shock absorbers are pushed toward the corresponding punches 142, and the diameters of the pipes 144 are expanded. Thereby, the shock can be more effectively absorbed.

Meanwhile, when a plurality of shock absorbers is provided, the shock absorbers may be arranged parallel to each other. Alternatively, as shown in FIG. 14, the shock absorbers may be configured such that the number of shock absorbers is increased from the front support 120*a* to the rear support 120*b*. In the latter case, a single shock absorber is provided between the front support 120*a* and the first intermediate support 120*c*. Two shock absorbers are provided between the first intermediate support 120*c* and the second intermediate support 120*c*. Three shock absorbers are provided between the second intermediate support 120*c* and the third intermediate support 120*c*. In this way, the shock absorbers are configured such that the number of shock absorbers is successively increased. Here, if the shock absorbers are arranged in a line, the shock absorbers may be imbalanced with respect to the upper, lower, left and right directions. Given this, the shock absorbers are disposed at positions at which they can be balanced. In order to provide a plurality of shock absorbers, the pipes 144 are disposed at predetermined positions, and the punches 142 corresponding to the pipes 144 are provided on the rear ends of the respective pipes 144.

Figure 15:
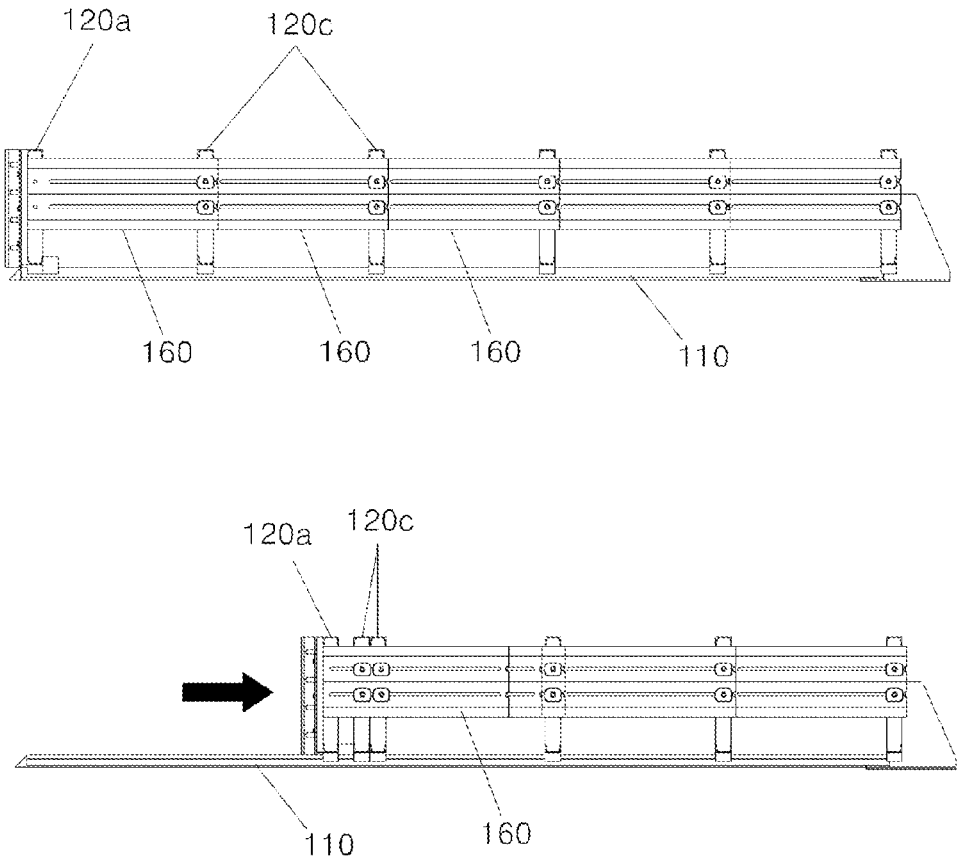
FIG. 15 is a view showing the operation of the crash cushion when a shock is applied thereto according to the present invention.

FIG. 15 is a view showing the operation of the crash cushion when a shock is applied thereto according to the present invention.

When a shock occurs due to a vehicle collision, the front support 120*a* is pushed backward along the rail 110. The sliding panel 160 that is fastened at the front end thereof to the front support 120*a* is pushed backward along with the front support 120*a* and overlaps the sliding panel 160 that is fastened at the front end thereof to the intermediate support 120*c*. If an impulse is comparatively large and the front support 120*a* is thus pushed to the intermediate support 120*c*, the front support 120*a* and the intermediate support 120*c* overlap each other and are pushed backward together. Furthermore, the sliding panel 160 that is fastened at the front end thereof to the intermediate support 120*c* is also pushed backward along with the intermediate support 120*c*. During this process, the portion of the sliding panel 160 in which the holes 162 are formed is broken by the bolt 142, whereby the shock can be more effectively absorbed. The sliding panel 160 thereafter overlaps the following sliding panel 160.

Figure 16:
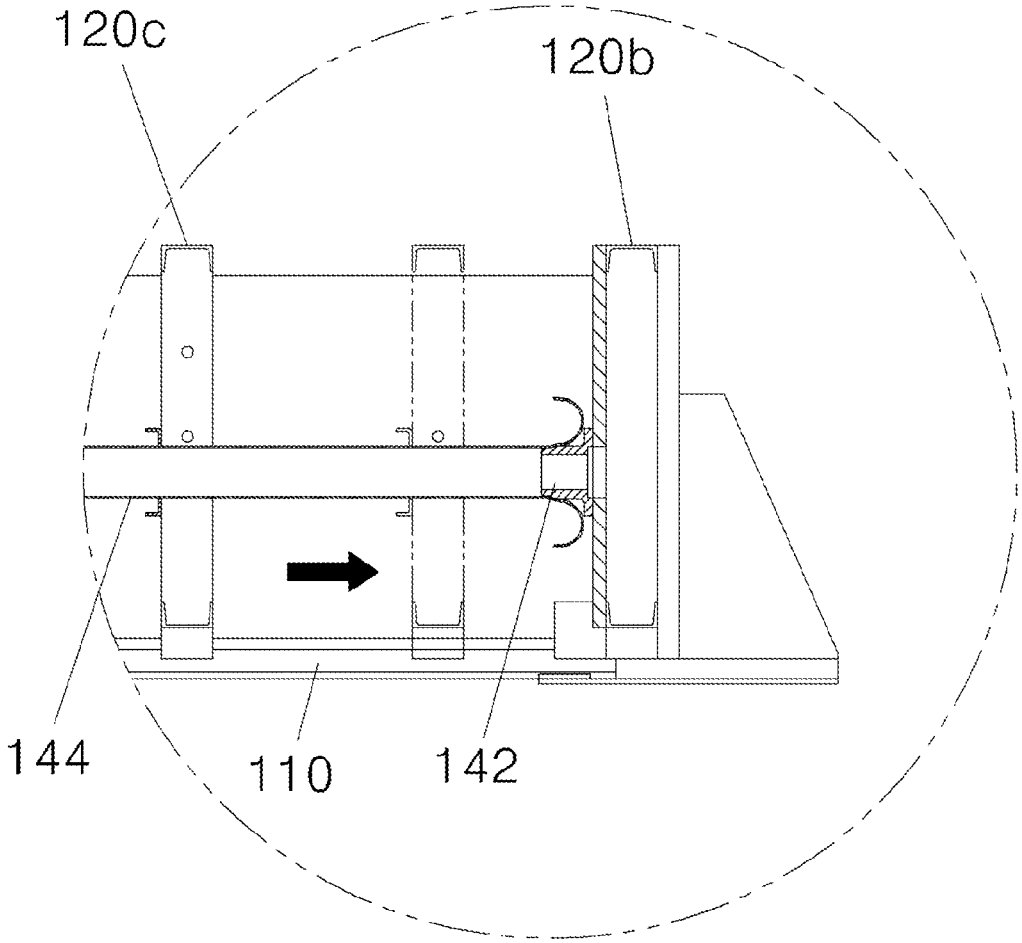
FIG. 16 is a view showing a pipe that is expanded in diameter by the punch of the shock absorber when a shock is applied to the crush cushion according to the present invention.

FIG. 16 is a view showing the pipe that is expanded in diameter by the punch of the shock absorber when a shock is applied to the crush cushion according to the present invention.

When a shock is applied to the front support 120*a* by a vehicle collision, the front support 120*a* is pushed backward along the rail 110, and the pipe 144 is also pushed backward. At this time, the rear end of the pipe 144 is torn into several parts by the punch 142 and thus expanded in diameter. As such, the pipe 144 made of metal is moved depending on the impulse and is expanded in diameter by the punch 142 so as to absorb the shock.

Figure 17:
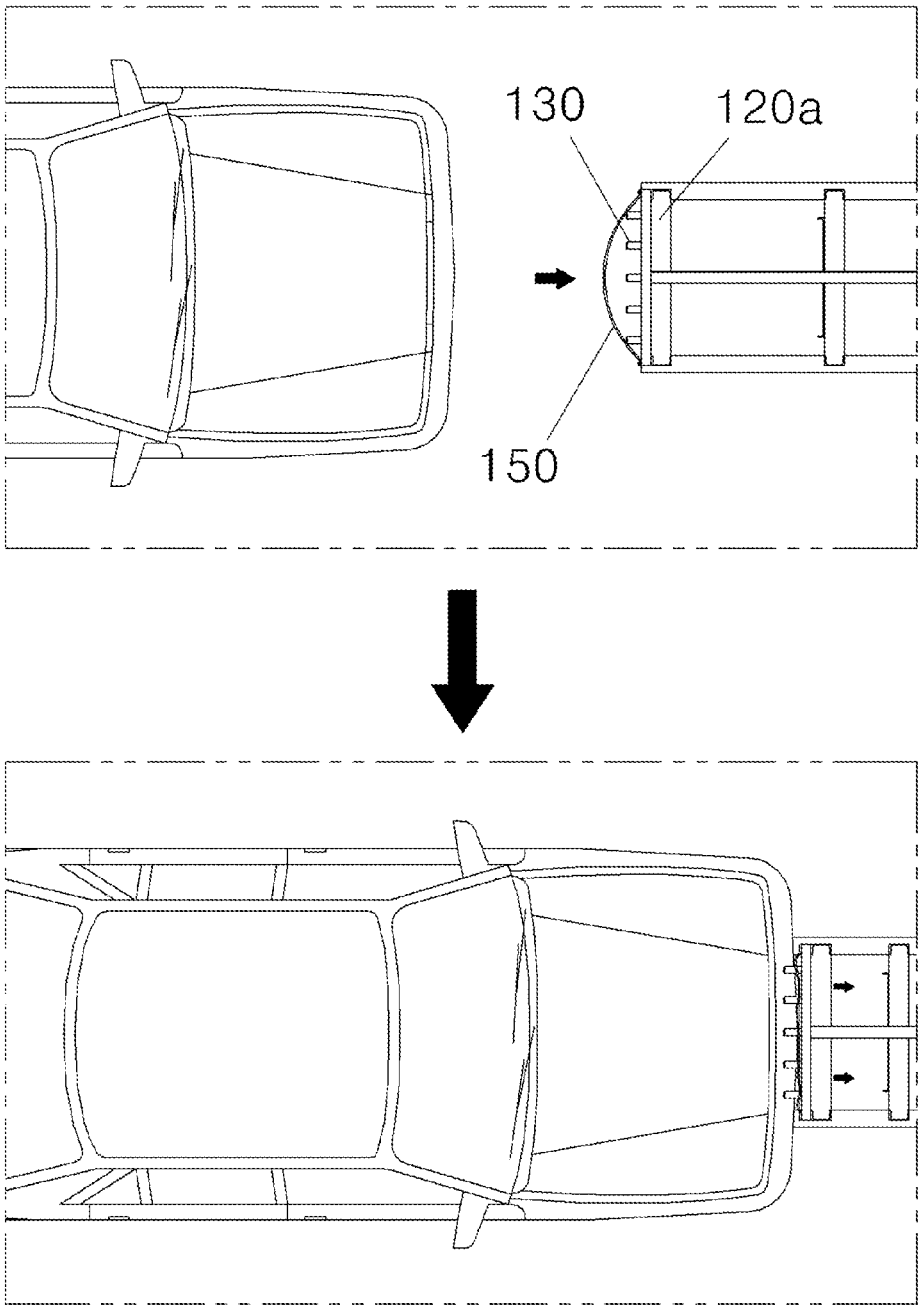
FIG. 17 is a view showing the operation of an embedding protrusion according to the present invention.

FIG. 17 is a view showing the operation of the embedding protrusions according to the present invention.

When a vehicle collides with the front support 120*a*, the embedding protrusions 130 are embedded into the bumper of the vehicle. If the cover plate 150 is present, the embedding protrusions 130 penetrate through the cover plate 150 and then are embedded into the bumper of the vehicle. Thereby, the vehicle that has collided with the crash cushion of the present invention can be prevented from undesirably slipping and bouncing. Consequently, the possibility of a secondary accident can be reduced.

Hereinafter, a process of installing the crash cushion according to the present invention having the above-mentioned construction will be explained. An example of direct installation of the crash cushion on a road will be described.

FIGS. 18 through 21 are views showing a process of installing the crash cushion according to the present invention.

Figure 18:
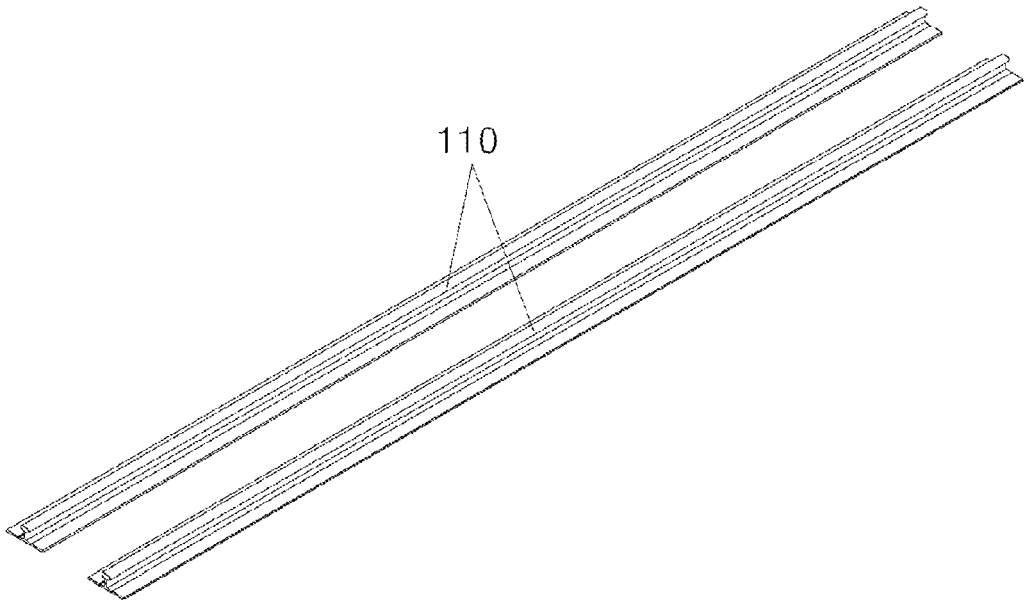
FIGS. 18 through 21 are views showing a process of installing the crash cushion according to the present invention.

First, as shown in FIG. 18, the rails 110 are installed on the ground surface after the ground surface has been arranged to be even. In this process, concrete is placed on the ground surface to form the positions for installation of the rails 110. This is to prevent the rails 110 from being removed from the ground surface. Although the two rails 110 have been illustrated in FIG. 18, only a single rail may be installed, as shown in FIG. 6.

Figure 19:
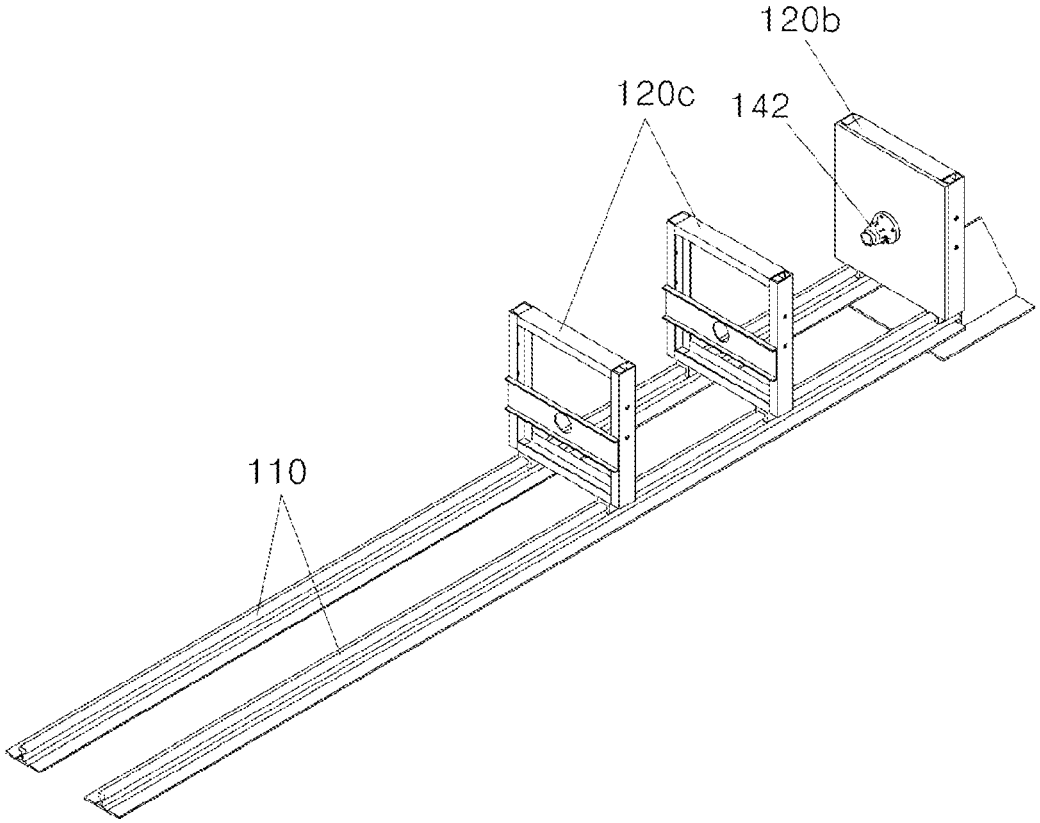

Thereafter, as shown in FIG. 19, the rear support 120*b* and the intermediate supports 120*c* are installed in the rails 110. The rear support 120*b* is firmly fixed on the ground surface by anchor bolts or the like so that the rear support 120*b* can be prevented from being pushed backward even when a comparatively large force is applied the crash cushion. As needed, a separate reinforcing device may be installed to prevent the rear support 120*b* from falling down. The intermediate supports 120*c* are disposed at positions preset in the design phase. Preferably, the rear support 120*b*, the intermediate supports 120*c* and the front support 120*a* are installed such that they are spaced apart from each other at regular intervals.

Figure 20:
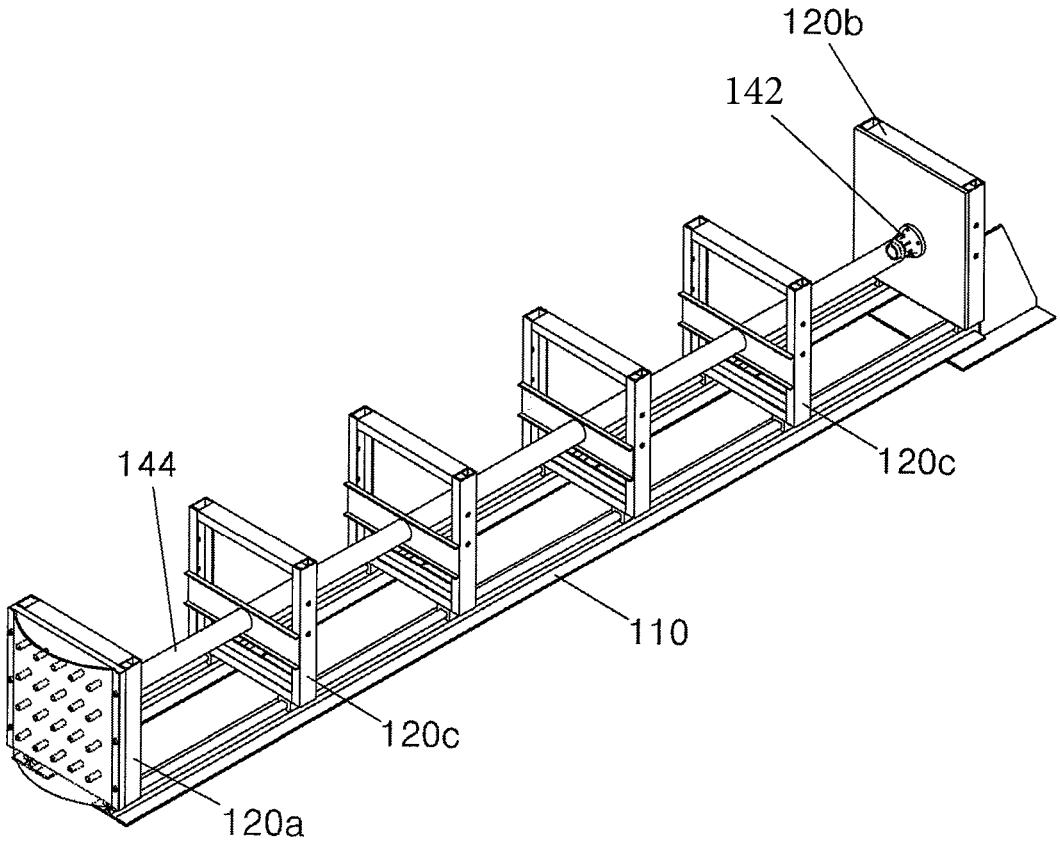

Subsequently, as shown in FIG. 20, the pipe 144 is installed to form the shock absorber, and then the front support 120*a* is installed. The pipe 144 passes through the holes formed in the intermediate supports 120*c*, and the rear end of the pipe 144 is supported by the rear support 120*b*. The punch 142 is fixed on the rear support 120*b*. The front end of the punch 142 is inserted into the rear end of the pipe 144. The front end of the pipe 144 is reliably fixed to the front support 120*a* by welding or the like.

Figure 21:
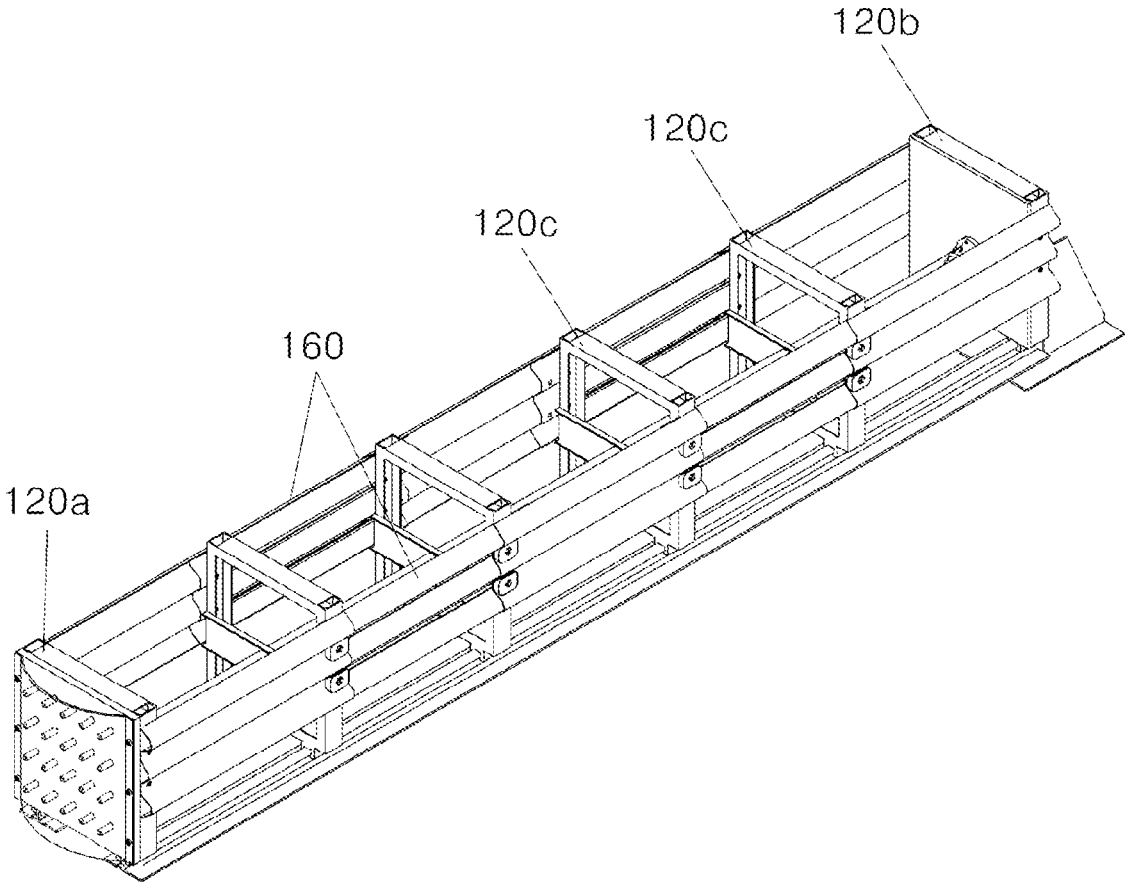

Finally, as shown in FIG. 21, the sliding panel 160 is installed. In this embodiment, a plurality of sliding panels 160 are provided and successively installed from the front support 120*a* to the rear support 120*b* such that the rear end of each preceding sliding panel 160 partially overlaps the front end of the following sliding panel 160. Through the above-mentioned process, the installation of the crash cushion according to the present invention is completed.

The invention claimed is:

1. A crash cushion, comprising:

a rail installed on a ground surface;

a front support installed on a front end of the rail, the front support including a slider such that the front support is pushed backward along the rail when a shock is applied to the front support;

a rear support installed on a rear end of the rail; and a shock absorber installed extending from the front support to the rear support and disposed at a predetermined height from the ground surface, the shock absorber comprising a punch and a pipe and shaped such that the pipe is expanded in a diameter by the punch as the shock is absorbed, wherein each punch includes a cutting blade shaped and positioned to cut the pipe as the pipe is expanded and the shock is absorbed.

2. The crash cushion of claim 1, wherein the punch is provided in a rear end of the pipe, the punch shaped to expand a diameter of the rear end of the pipe when the pipe is pushed backward by a vehicle collision.

3. The crash cushion of claim 1, wherein an embedding protrusion is provided on the front support such that when the vehicle collides with the crash cushion, the embedding protrusion is embedded into a front bumper of the vehicle, whereby the vehicle is prevented from slipping.

4. The crash cushion of claim 1, further comprising:

an intermediate support installed on the rail between the front support and the rear support, the intermediate support supporting the shock absorber and being pushed backward when the shock is applied.

5. The crash cushion of claim 4, wherein the rail consists of a single rail, and the front support, the rear support (120*b*) and the intermediate support (120*c*) are installed on the single rail, wherein the front support and the intermediate support are configured so as to be tiltable to the left or right by not more than a predetermined angle.

6. The crash cushion of claim 1, wherein the shock absorber comprises a first shock absorber disposed between the front support and the intermediate support and a second shock absorber disposed between the intermediate support and the rear support, wherein the first shock absorber includes a first punch fastened to the intermediate support and shaped to expand a rear end of a first shock absorber pipe, and wherein the second shock absorber includes a second punch fastened to the rear support and shaped to expand a rear end of a second shock absorber pipe.

7. The crash cushion of claim 6, wherein a number of shock absorbers installed between the front support and the intermediate support is less than a number of shock absorbers installed between the intermediate support and the rear support.

8. The crash cushion of claim 1, further comprising a sliding panel installed extending from the front support to the rear support, the sliding panel covering the front support and the rear support, wherein the sliding panel comprises a plurality of sliding panels each of which is fastened at a front end thereof to the front support or to the intermediate support so that when the front support and the intermediate support are pushed backward, the sliding panels overlap each other.

9. The crash cushion of claim 8, wherein holes are formed in the sliding panel and arranged in a line in a longitudinal direction of the sliding panel, and a bolt is coupled to the hole that is disposed in a rear end of the sliding panel so that when the sliding panel is pushed backward, the holes are successively ruptured by the bolt, whereby the shock is absorbed.

10. The crash cushion of claim 8, wherein a slit is longitudinally formed in the sliding panel, wherein a width of the slit is less than a diameter of the bolt so that when the sliding panel is pushed backward, the bolt expands the width of the slit, whereby the shock is absorbed.

11. The crash cushion of claim 1, wherein the punch comprises a large diameter part inserted at a rear end thereof into the pipe, the large diameter part being increased in diameter toward a front end thereof so that when the pipe is pushed, a diameter of the pipe is expanded by the large diameter part (143).

12. The crash cushion of claim 1, wherein a space between the front support and the rear support is filled with a buffer.

13. The crash cushion of claim 1, wherein each punch includes at least one radially extending cutting blade.

14. The crash cushion of claim 1, further comprising:

a roller shaped and located to facilitate the front panel moving towards the back panel along the rail.

15. A crash cushion comprising:

two parallel rails installed on a ground surface;

a front support;

a first intermediate support;

a first shock absorber located between the front support and the first intermediate support;

a second intermediate support;

a second shock absorber and a third shock absorber located in parallel with each other and located between the first intermediate support and the second intermediate support, wherein a region between the first intermediate support and the second intermediate support includes more shock absorbers than a region between the front support and the first intermediate support;

a third intermediate support;

a fourth shock absorber and a fifth shock absorber and a sixth shock absorber located in parallel with each other and located between the second intermediate support and the third intermediate support, wherein a region between the second intermediate support and the third intermediate support includes more shock absorbers than the region between the front support and the first intermediate support;

a rear support; and a seventh shock absorber and an eighth shock absorber and a ninth shock absorber and a tenth shock absorber located in parallel with each other and located between the third intermediate support and the rear support, wherein a region between the third intermediate support and the rear support includes more shock absorbers than the region between the second intermediate support and the third intermediate support, wherein each of the first through tenth shock absorbers comprises a pipe and a punch respectively.

* * * * *